US010614649B2

(12) United States Patent
Brockman et al.

(10) Patent No.: US 10,614,649 B2
(45) **Date of Patent: *Apr. 7, 2020**

(54) SYSTEM AND APPARATUS FOR STORING OBJECTS

(71) Applicant: Key Control Holding, Inc., Houston, TX (US)

(72) Inventors: Robert T. Brockman, Houston, TX (US); John Michael Besosa, College Station, TX (US)

(73) Assignee: Key Control Holding, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/227,842

(22) Filed: Dec. 20, 2018

(65) Prior Publication Data

US 2019/0122474 A1 Apr. 25, 2019

Related U.S. Application Data

(62) Division of application No. 15/693,759, filed on Sep. 1, 2017, now Pat. No. 10,198,888.

(60) Provisional application No. 62/385,775, filed on Sep. 9, 2016.

(51) Int. Cl.

| | |
|---|---|
| ***G07C 9/00*** | (2020.01) |
| ***E05B 47/06*** | (2006.01) |
| ***E05B 19/00*** | (2006.01) |
| ***E05B 47/00*** | (2006.01) |
| ***E05B 65/00*** | (2006.01) |
| ***E05G 1/08*** | (2006.01) |
| ***E05B 65/02*** | (2006.01) |
| ***E05G 1/04*** | (2006.01) |

(52) U.S. Cl.

CPC ..... *G07C 9/00944* (2013.01); *E05B 19/0005* (2013.01); *E05B 47/0004* (2013.01); *E05B 47/0603* (2013.01); *E05B 47/0619* (2013.01); *E05B 65/0075* (2013.01); *E05B 65/025* (2013.01); *E05G 1/04* (2013.01); *E05G 1/08* (2013.01); *G07C 9/00896* (2013.01); *E05B 2047/0048* (2013.01); *E05B 2047/0068* (2013.01); *E05G 2700/00* (2013.01); *G07C 2009/00936* (2013.01)

(58) Field of Classification Search

CPC ..... E05B 65/0075; E05B 19/0005; G07C 9/00944

See application file for complete search history.

(56) References Cited

U.S. PATENT DOCUMENTS

| | | | | |
|---|---|---|---|---|
| 6,102,162 A * | 8/2000 | Teicher | G07F 17/0042 | 186/39 |
| 6,882,282 B1 * | 4/2005 | Lie-Nielsen | G07C 9/27 | 340/686.1 |
| 7,336,174 B1 * | 2/2008 | Maloney | G08B 13/1427 | 340/568.1 |
| 8,342,400 B1 * | 1/2013 | Reese | G06F 19/3462 | 235/385 |

(Continued)

*Primary Examiner* — Santiago Garcia
(74) *Attorney, Agent, or Firm* — Adolph Locklar

(57) ABSTRACT

The modular asset storage system includes a main panel, the main panel including a computer command module and one or more asset containment modules. The asset containment modules are in data communication with the computer command module.

16 Claims, 13 Drawing Sheets

(56) References Cited

U.S. PATENT DOCUMENTS

2003/0231102 A1* 12/2003 Fisher ..... G07C 9/00912 340/5.73
2004/0037054 A1* 2/2004 Ice ..... H05K 7/1404 361/752
2004/0111323 A1* 6/2004 Niederland ..... A47G 29/10 705/22
2004/0212973 A1* 10/2004 Ice ..... H05K 7/1404 361/796
2005/0206499 A1* 9/2005 Fisher ..... E05B 19/0005 340/5.73
2006/0220842 A1* 10/2006 Breed ..... G06Q 10/06 340/539.13
2007/0040682 A1* 2/2007 Zhu ..... G06Q 10/087 340/572.1
2008/0258869 A1* 10/2008 Ognjenovic ..... A47G 29/10 340/5.73
2008/0302744 A1* 12/2008 Rosenberg ..... A47F 5/0025 211/94.01
2008/0317025 A1* 12/2008 Manula ..... H04Q 1/06 370/389
2009/0182749 A1* 7/2009 Walker ..... G06Q 10/00
2012/0229279 A1* 9/2012 Conley ..... G06Q 10/087 340/568.1
2014/0088979 A1* 3/2014 Garman ..... G06Q 10/0631 705/1.1
2014/0253331 A1* 9/2014 Fawcett ..... G08B 13/2434 340/568.2
2015/0262460 A1* 9/2015 Ito ..... G08B 13/22 340/568.1
2016/0089303 A1* 3/2016 Latorraca ..... G07F 11/62 312/209
2017/0330666 A1* 11/2017 Dames ..... H01F 7/1646
2017/0361208 A1* 12/2017 Chun ..... A63F 1/067
2018/0127212 A1* 5/2018 Jarvis ..... B65G 1/0435

* cited by examiner

SYSTEM AND APPARATUS FOR STORING OBJECTS

CROSS-REFERENCE TO RELATED APPLICATIONS

This application is a divisional application which claims priority from U.S. utility application Ser. No. 15/693,759, filed Sep. 1, 2017 which is itself a nonprovisional application that claims priority from U.S. provisional application No. 62/385,775, filed Sep. 9, 2016, which is incorporated herein by reference.

TECHNICAL FIELD/FIELD OF THE DISCLOSURE

The present disclosure relates to systems and apparatuses for storing and controlling access to objects.

BACKGROUND OF THE DISCLOSURE

Traditionally, business and government entities such as automobile dealers, hotels, hospitals, military and other governmental agencies may want to control access to, for instance, vehicles, facilities, funds, information, and valuable objects to only certain people or groups of people. One form of an access control device may be a key or card. Limiting access to the key or card, together with knowledge of who has been allowed access to the key or card, may be useful to such entities. In addition to limiting access and maintaining a record of who has an access control device, business and government agencies may wish to control access to items which are valuable. Storage and limiting access to access control devices and valuable objects (collectively referred to hereinafter as "assets") is a traditional problem for business and government entities. Traditional methods such as sign out sheets may be used, but sign out sheets rely on the accuracy of persons implementing the sign out sheet and provides limited or no access control.

SUMMARY

A modular asset storage system is disclosed. The modular asset storage system includes a main panel, the main panel including a computer command module and one or more asset containment modules. The asset containment modules are in data communication with the computer command module.

An asset unlocking method is disclosed. The asset unlocking method includes providing a main panel, the main panel including a computer command module and one or more asset containment modules. The asset containment modules are in data communication with the computer command module. The method also includes transmitting an instruction from the computer command module to the asset containment module to allow access to an asset and receiving the instruction at the asset containment module. The method also includes determining whether the asset is present in the asset containment module, and, if the asset is present, communicating the presence of the asset from the asset containment module to the computer command module. The method also includes providing access to the asset.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
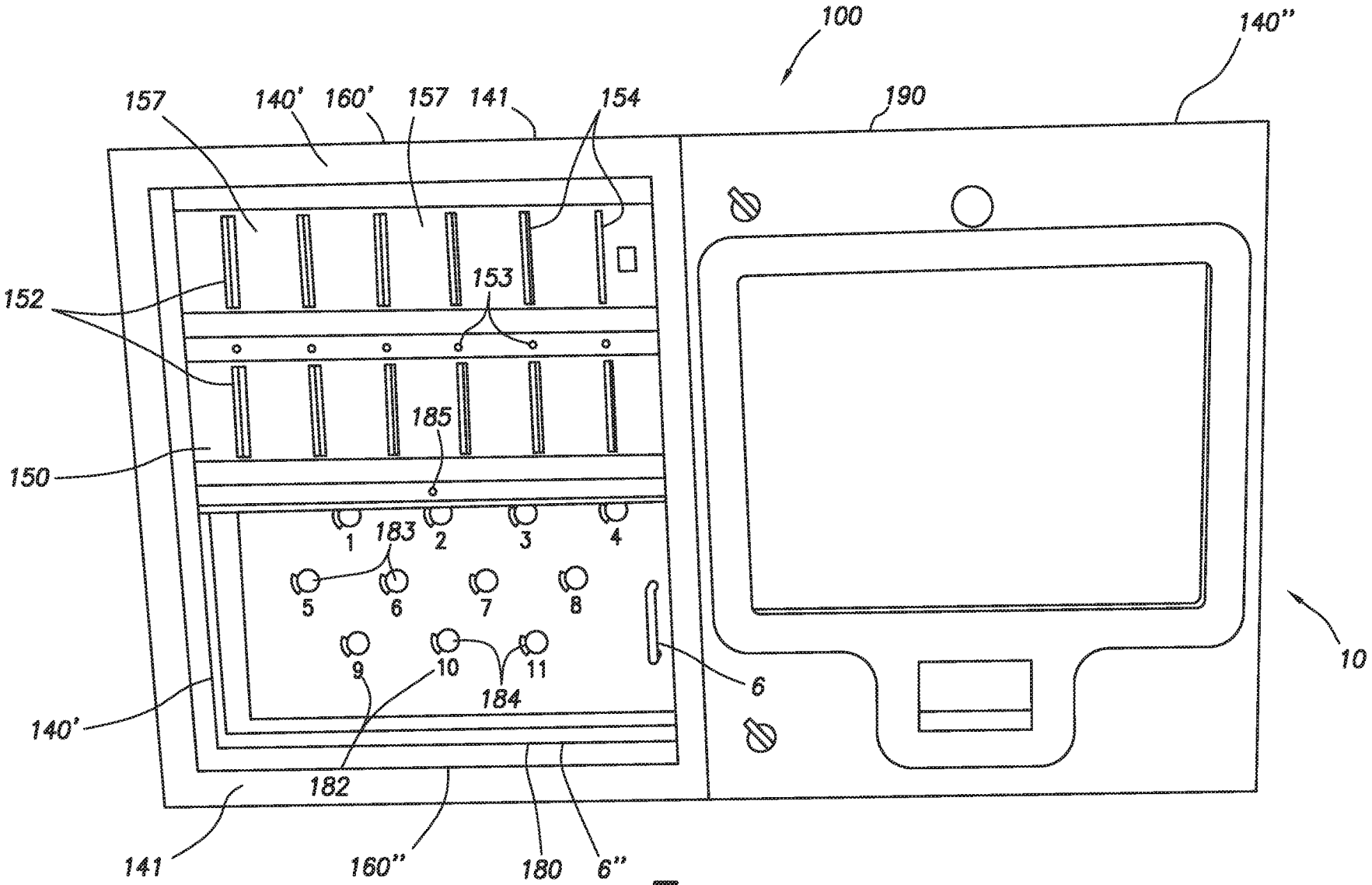
FIG. 1 is a graphical depiction of a main panel consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts main panel 100 of modular asset storage system 10 consistent with certain embodiments of the present disclosure. As used herein, "modular" means modular asset storage system 10 is composed or partially composed of modules that may be configured, such as by removal and replacement with other modules. A module is a separable component that is interchangeable with others, for assembly into units of differing size, complexity, or function. As depicted in FIG. 1, main panel 100 includes two asset containment modules 140' and computer command module 140". While FIG. 1 depicts main panel 100 as having two asset containment modules 140', any number of asset containment modules 140' may be included in main panel 100. In FIG. 1, asset containment modules 140' are depicted on the left side of main panel 100 and computer command module 140" is depicted on the right side. Because asset containment modules 140' and computer command module 140" are modular, the positions of asset containment modules 140' and computer command module 140" may be reversed.

Computer command module 140" is configured to control access to access control devices or other objects, as described hereinbelow. Asset containment modules 140' may include, but are not limited to, locker box modules, card modules, and key modules. Computer command module 140" may be in data communication with the one or more asset containment modules 140'. As used herein, "data communication" refers to one-way or two-way transmission of data between components. In certain embodiments, asset containment modules 140' may be contained in expansion bays 141. As used herein, "expansion bay" is an open section in main panel 100 or expansion panel 200, described hereinbelow, available for installation of asset containment module 140'. For example, as depicted in FIG. 1, main panel 100 includes upper expansion bay 160' and lower expansion bay 160". While shown as having two expansion bays, main panel 100 may include any number of expansion bays. Further, although main panel 100 is depicted in FIG. 1 as having upper expansion bay 160' and lower expansion bay 160", expansion bays 141 of main panel 100 may be located side-by-side or in any other configuration.

In some embodiments, asset containment module 140' is a locker box. A locker box may be an open box having a door. The door of the locker box may be configured and operated as described hereinbelow as door 6.

In the embodiment depicted in FIG. 1, upper expansion bay 160' includes card module 150. Card module 150 includes face plate 157; face plate 157 includes a plurality of card slots 152 configured to receive cards 154. Cards 154 may be any type of card, including, without limitation, key cards, credit cards, or debit cards. Although card module 150 is shown in FIG. 1 as having two parallel rows of card slots 152, card slots 152 may be positioned in any configuration within card module 150. As further shown in FIG. 1, lower expansion bay 160" includes key module 180. Key module 180 includes a plurality of key slots 182 configured to receive keys 184. Although key module 180 is shown as having three rows of key slots 182, key slots 182 may be positioned in any configuration within key module 180.

In certain embodiments, asset containment module 140' may include door 6 positioned so as to restrict access to the assets within asset containment module 140', such as assets positioned within slots in asset containment module 140' as in card slots 152 and/or key slots 182. As shown in FIG. 1, door 6 restricts access to keys 184 within key module 180. In certain embodiments, door 6 may include window 6" to allow viewing of the assets behind door 6.

In certain embodiments, as shown in FIG. 1, an indicator light, such as an LED may be associated with each card slot 152, each key slot 182 and door 6. FIG. 1 depicts a plurality of card slot indicator lights 153, a plurality of key slot indicator lights 183, and a door indicator light 185. In certain embodiments, when a user is granted access to a particular asset, such as a key or card, card slot indicator light 153 or key slot indicator light 183 may light, thereby alerting the user as to which asset is available. Further, when a user is granted access to asset containment module 140', door indicator light 185 may light, thereby alerting the user as to which asset containment module 140' is available.

In some embodiments, main panel 100 may include housing 190 in which asset containment modules 140' and computer command module 140" are contained. Housing 190 may be constructed of any suitable material, including without limitation, metal, polymer, ceramic, or fiberglass.

Figure 2:
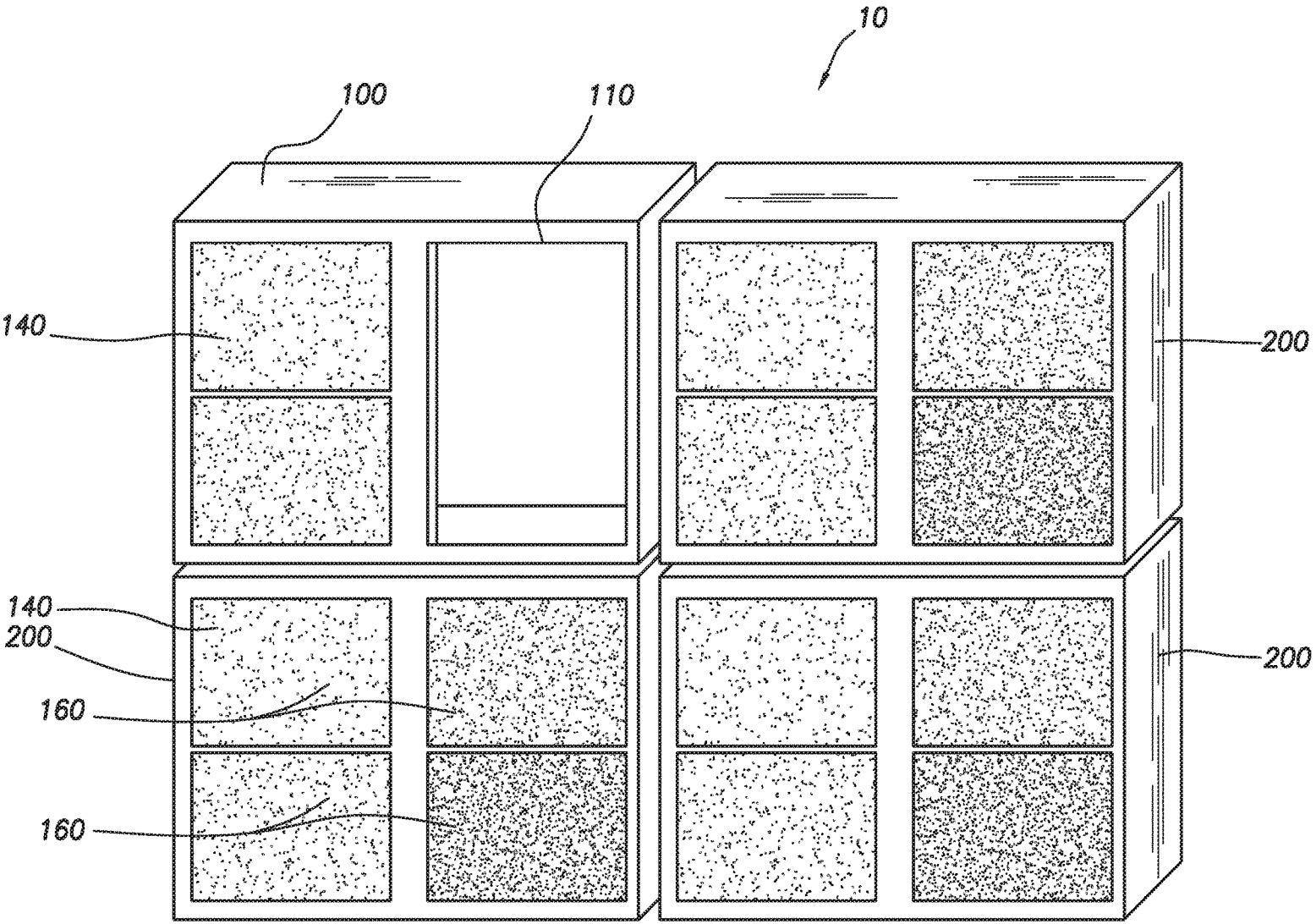
FIG. 2 is a diagram of an modular asset storage system consistent with at least one embodiment of the present disclosure.

FIG. 2 depicts another embodiment of modular asset storage system 10. Modular asset storage system 10 includes main panel 100. In certain embodiments, modular asset storage system 10 may include, in addition to main panel 100, one or more expansion panels 200. Expansion panels 200 may include one or more expansion bays 160 having asset containment modules 140 disposed therein. While modular asset storage system 10 is depicted in FIG. 2 as having three expansion panels 200, any number of expansion panels 200 may be included as part of modular asset storage system 10. In some embodiments, an expansion bay 160 may be empty, that is, may not include an asset containment module 140. In such an embodiment, a blank module cover may be installed over expansion bay 160. Expansion panels 200 may be data and electrically connected to main panel 100.

In some embodiments, modular asset storage system 10 may include only main panel 100. In other embodiments, modular asset storage system 10 may include multiple main panels 100. In some embodiments, such as depicted in FIG. 2, multiple asset containment modules 140, for example and without limitation, up to ten expansion asset containment modules 140, may be controlled by a single computer command module 110. Expansion panels 200 and the corresponding asset containment modules 140 located therein may be in electrical and data communication in serial connection or parallel connection to a single computer command module 110, as depicted in FIG. 2. In other embodiments, expansion panels 200 and the corresponding asset containment modules 140 located therein may be electrical and data communication in a network to multiple computer command modules 110.

Figure 3:
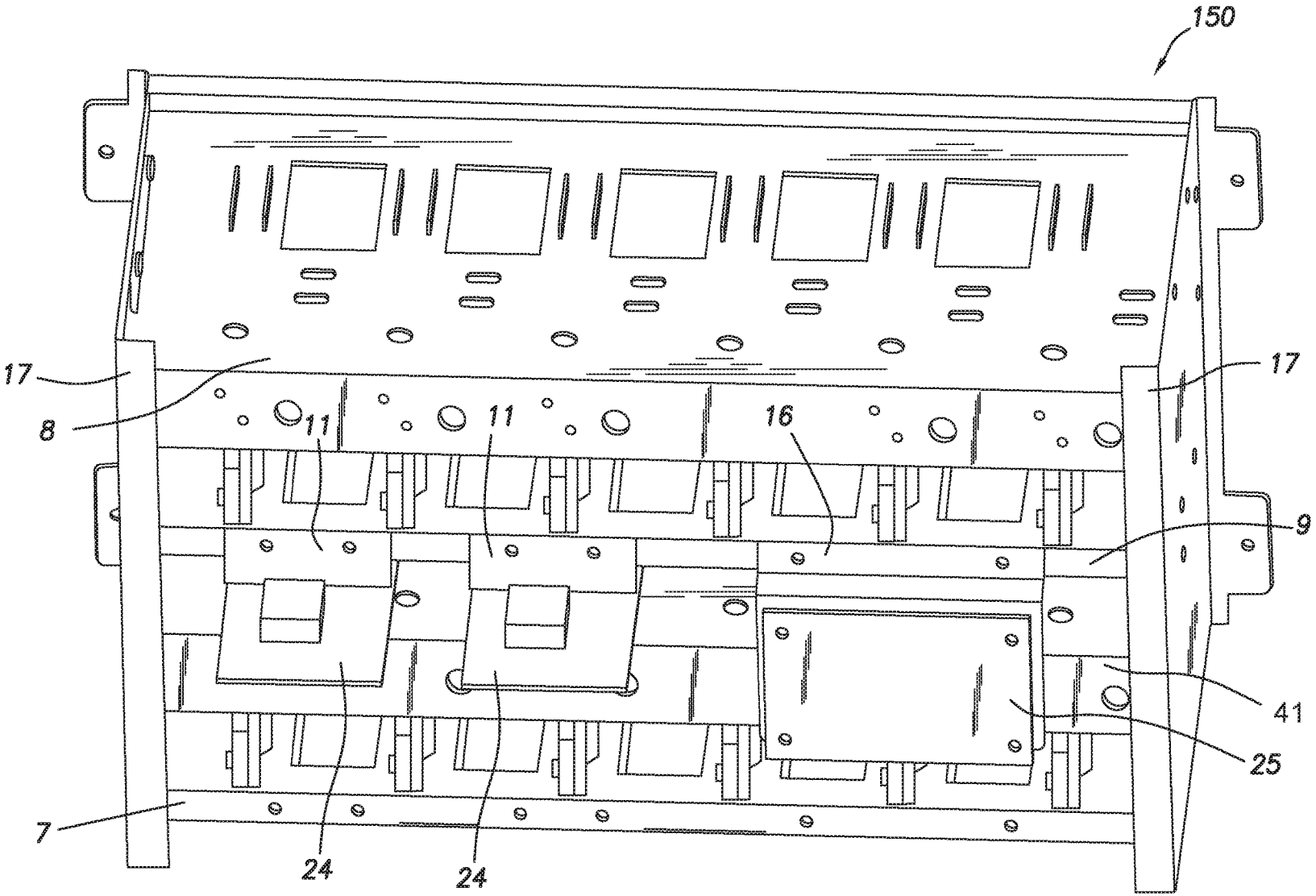
FIG. 3 is a rear cutaway view of a card module consistent with at least one embodiment of the present disclosure.

FIGS. 3-8 depict one embodiment of card module 150. While described with respect to card module 150, the following figures and description also apply to key module 180. FIG. 3 depicts a rear view of one embodiment of card module 150. Card module 150 includes outer wrap 17. Outer wrap 17 may be a housing within which the remainder of card module 150 is located. In the two parallel row of card slots 152 embodiment depicted in FIG. 2, upper plate 8, upper middle plate 9, lower middle plate 41, and lower plate 7 are mounted to outer wrap 17 as shown in FIG. 3. Upper plate 8, upper middle plate 9, lower middle plate 10, and lower plate 7 provide support and mounting surfaces for components located within card module 150. As further shown in FIG. 3, row board mounting brackets 11 are mounted to upper middle plate 9. Row boards 24 are mounted to row board mounting brackets 11, which are mounted to upper middle plate 9. In certain embodiments, row boards 24 may be microcontrollers. Control board mounting bracket 16 is mounted on upper middle plate 9 and lower middle plate 10. Control board mounting bracket 16 is configured to mount control board 25.

Figure 4:
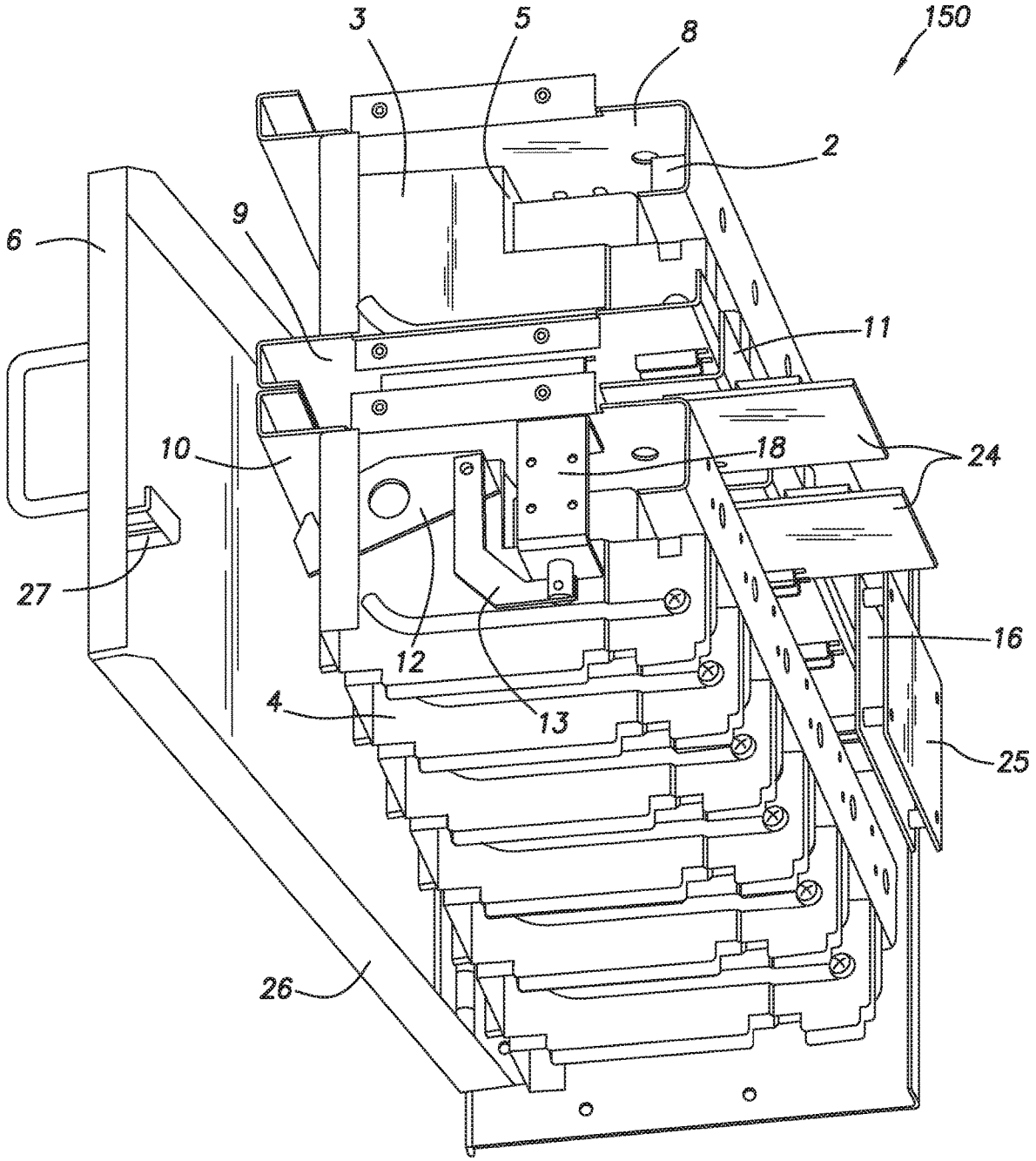
FIG. 4 is a side cutaway view of a card module consistent with at least one embodiment of the present disclosure.

FIG. 4 is a side view of one embodiment of card module 150. FIG. 4 depicts upper U-channel bracket 3. Card module 150 includes a plurality of upper U-channel brackets 3, one for each of card slots 152 in the upper row of card slots 152. Upper U-channel brackets 3 are mounted to upper middle plate 9. Upper U-channel bracket 3 provides support and a sliding surface for card carrier 5. Card carrier 5 may be a box having one or more open sides. Card carrier 5 is adapted to receive and allow removal of card 154, as described hereinabove. FIG. 4 further depicts lower U-channel bracket 4, each of which acts as a support and sliding surface for each of card carriers 5 located in the lower row of card slots 152. Upper U-channel bracket 3 and lower U-channel bracket 4 are configured to allow card carriers 5 to slide along in an inside surface of upper U-channel bracket 3 and lower U-channel bracket 4.

Figure 11:
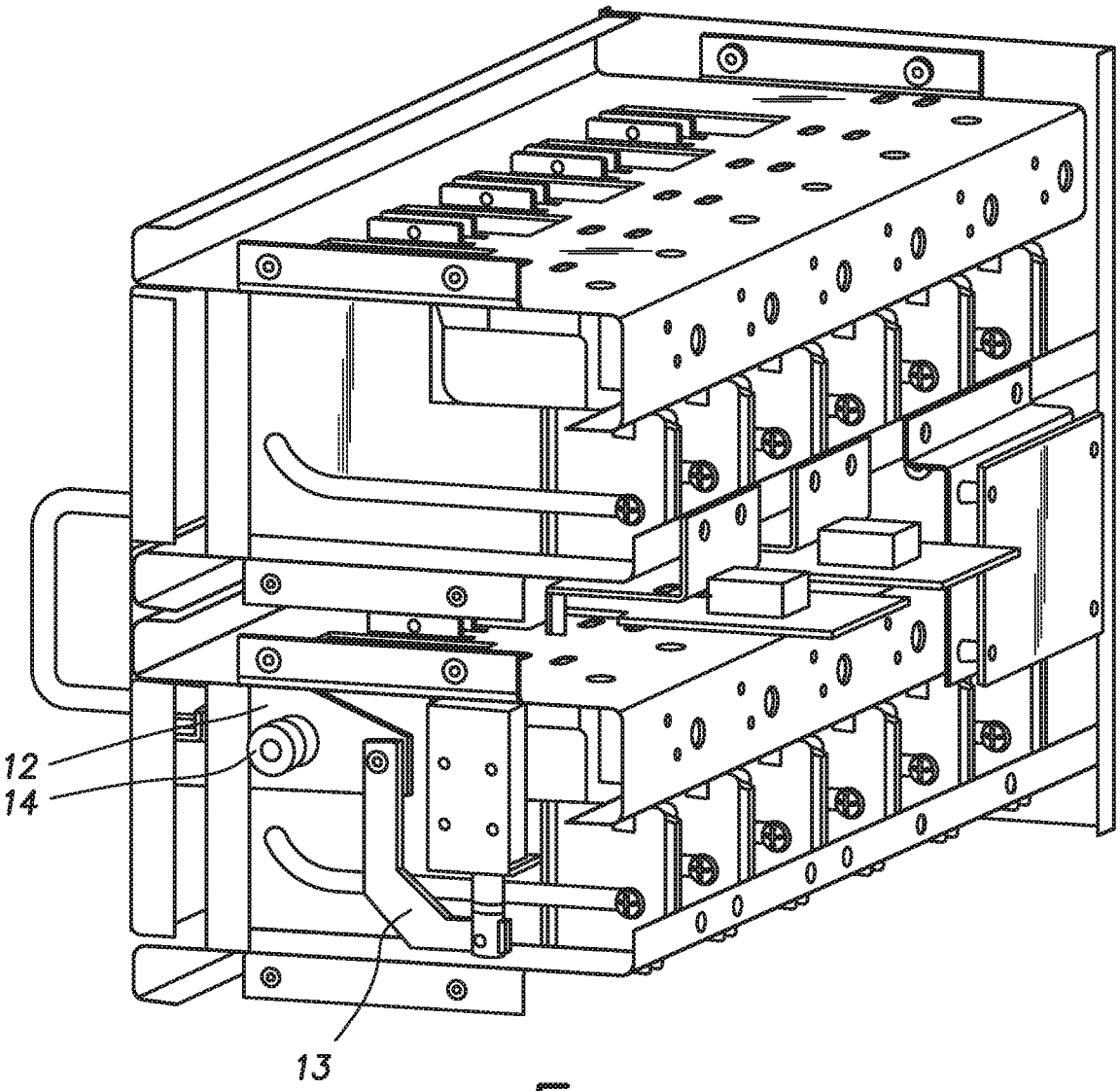
FIG. 11 is a side cutaway view of a card module consistent with at least one embodiment of the present disclosure.

FIGS. 4 and 11 further depicts door actuator system 26. Door actuator system 26 includes door solenoid 18, cam actuator 13, cam latch 12, and door latch 27. In the embodiment shown in FIGS. 4 and 11, door solenoid 18 is a push-pull solenoid. In certain embodiments, door solenoid 18 is mounted to the interior of the outer wrap (17 not shown for visibility). When engaged electronically by control board 25, door solenoid 18 retracts ("pulls") and pulls cam actuator 13. Cam actuator 13 is mechanically connected to cam latch 12; when cam actuator 13 is pulled by door solenoid 18, cam actuator forces cam latch 12 to pivot on latch standoff 14. The upward motion at the rear of cam latch 12 caused by the cam actuator 13 forces the front portion of cam latch 12 downwards. This action separates door latch 27 from cam latch 12, thereby releasing door 6, enabling the door to be opened by the user.

Figure 5:
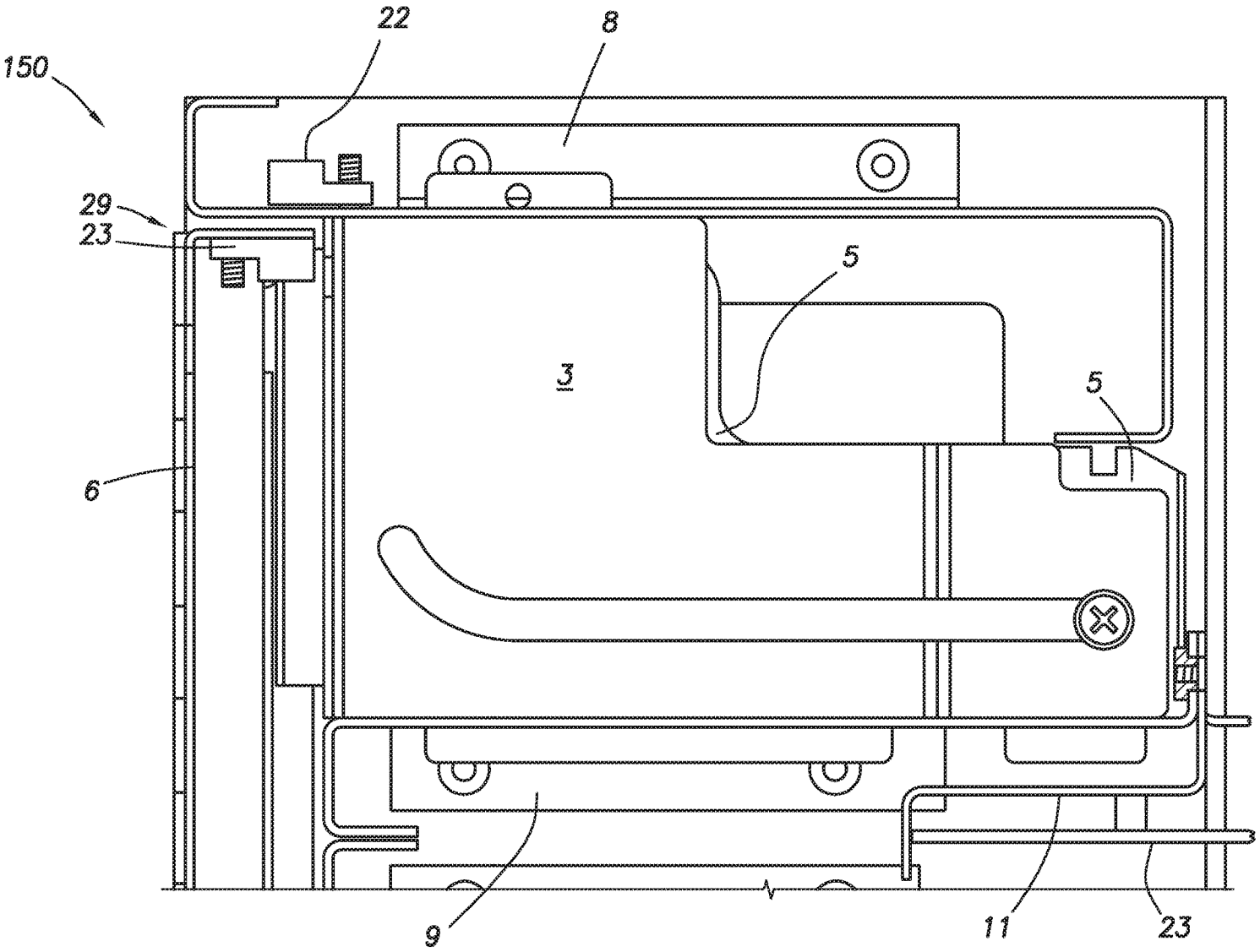
FIG. 5 is a side cutaway view of a card module consistent with at least one embodiment of the present disclosure.

FIG. 5 is side view of one embodiment of card module 150. FIG. 5 depicts door sensor system 29. As shown in FIG. 5, door sensor system 29 is a reed switch. Door sensor system 29 includes door sensor actuator mounted to door 6 and door sensor 22 mounted to upper plate 8. Door sensor actuator 23 moves with door 6. When door sensor 22 measures that door sensor actuator 23 has moved out of proximity of door sensor 22, door sensor 22 registers that door 6 is open. Other door sensor systems include, but are not limited to a push-button switch, micro-switch, acoustic sensor, optical sensor, or magnetic hall-effect sensor.

Figure 6:
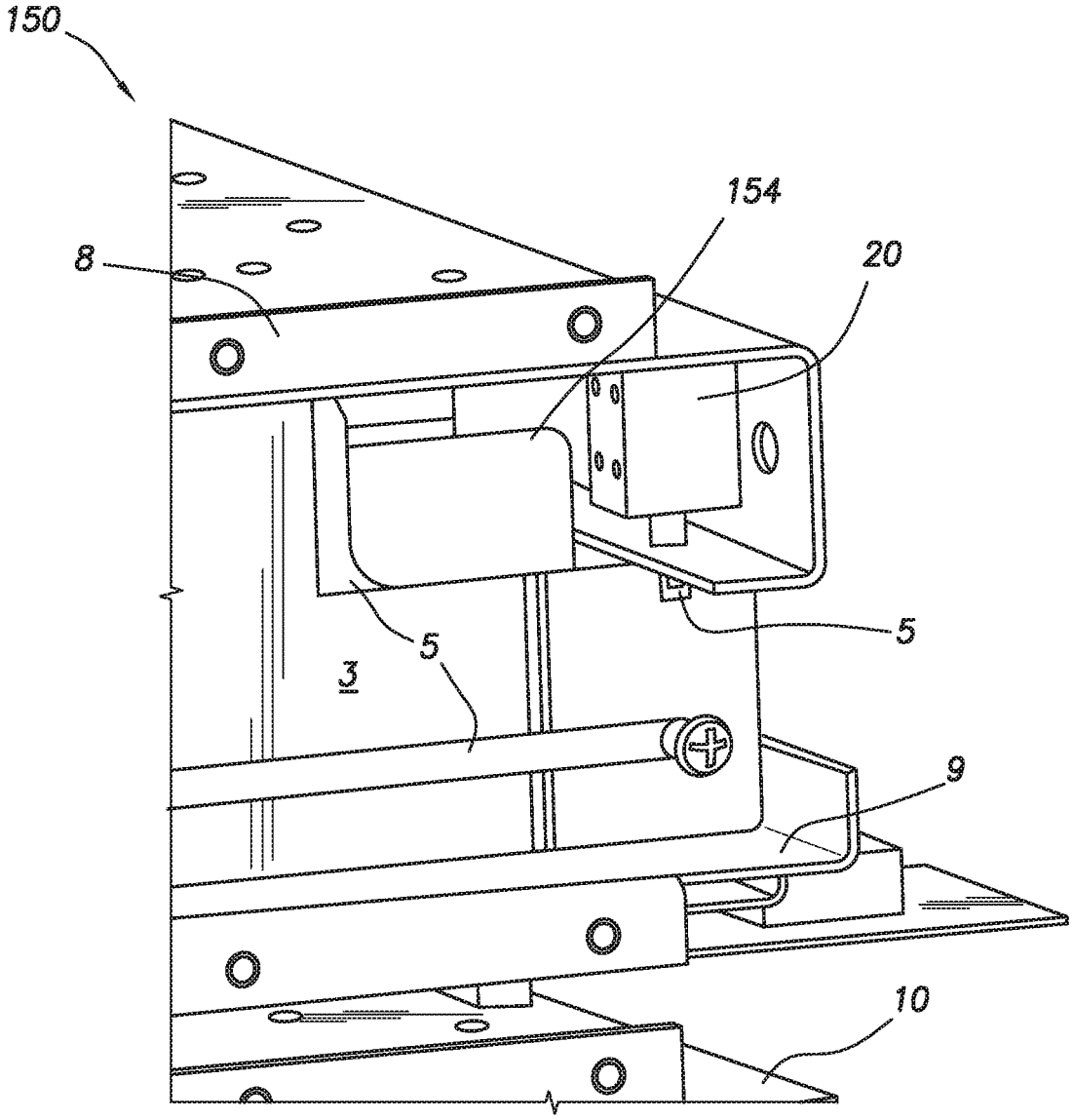
FIG. 6 is a side cutaway view of a card module consistent with at least one embodiment of the present disclosure.

FIG. 6 is a side view of card module 150. FIG. 6 depicts locking solenoid 20 mounted to upper plate 8. Locking solenoid 20 is configured to receive card carrier 5. When locking solenoid 20 is energized, card carrier 5 is held in place, which thereby restricts movement of card 154 to within card carrier 5. When locking solenoid 20 is de-energized, card carrier 5 may slide along the interior surface of upper U-channel bracket 3 or lower U-channel bracket 4, thereby allowing access to card 154. In certain embodiments, card carrier 5 may be restricted from complete removal from card module 150, such as through the use of a pin.

Figure 7:
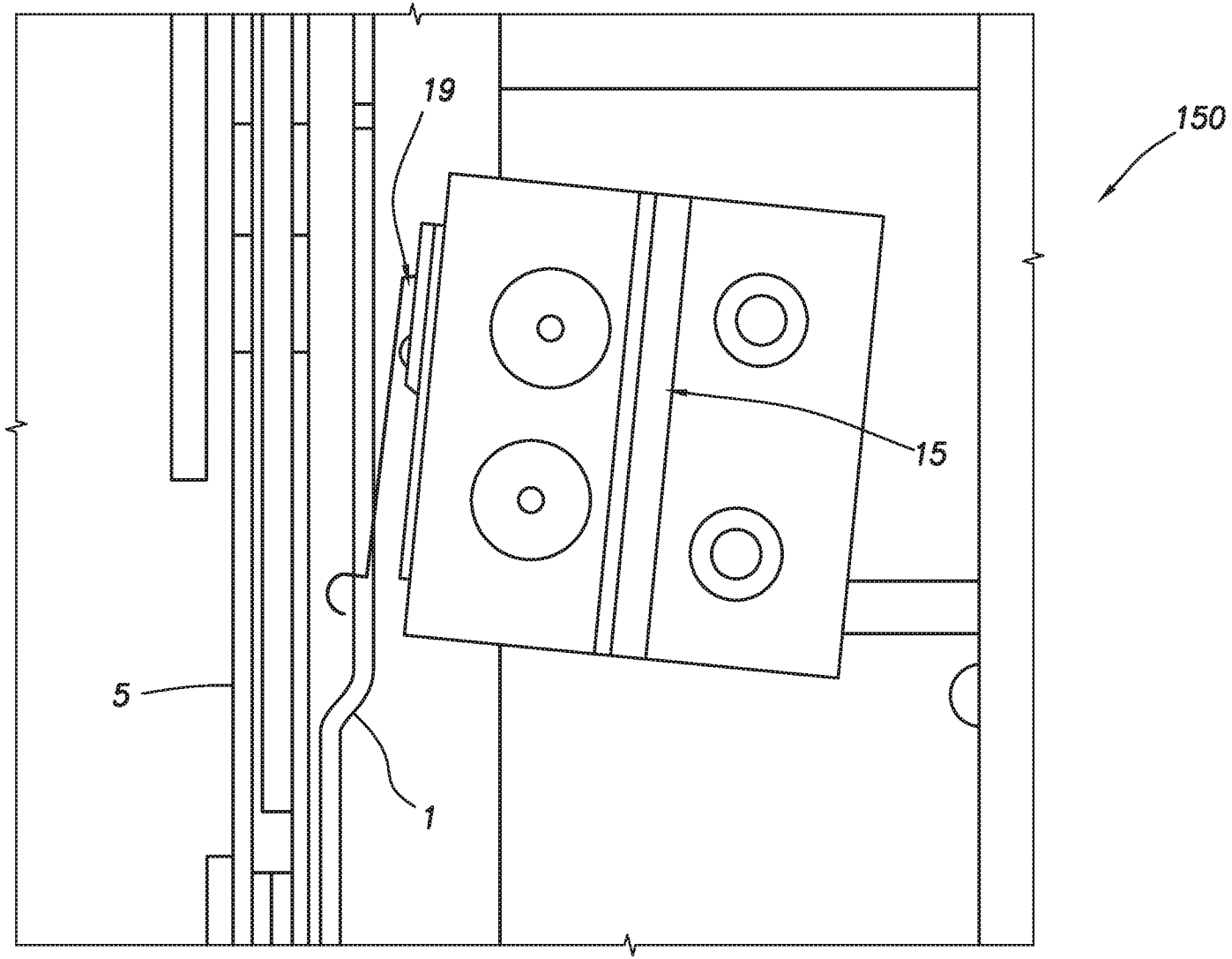
FIG. 7 is a top cutaway view of a card module consistent with at least one embodiment of the present disclosure.
Figure 8:
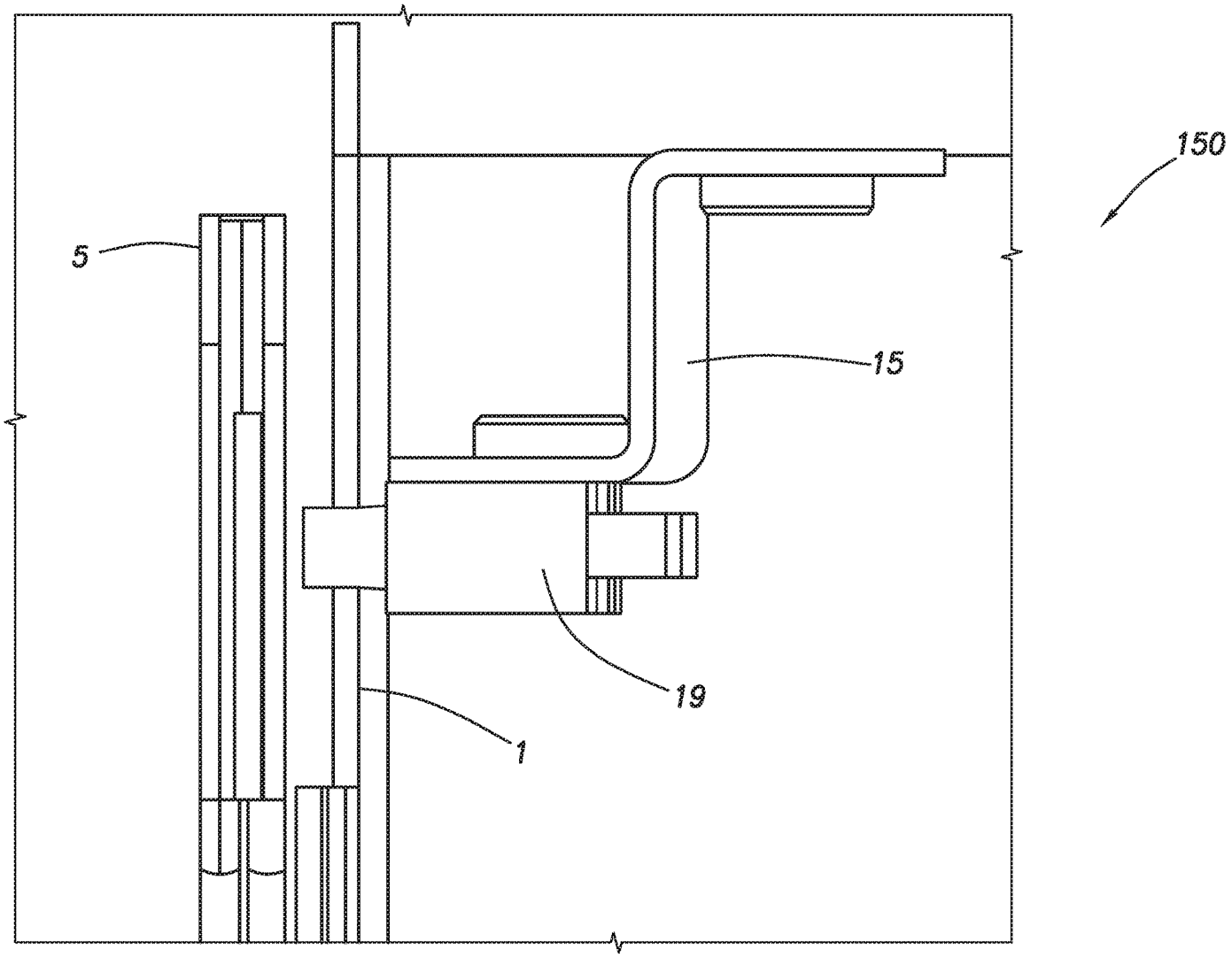
FIG. 8 is a cutaway rear view of card module consistent with at least one embodiment of the present disclosure.

FIG. 7 is a cutaway top view of card module 150. FIG. 7 depicts card presence sensor 19 mounted on card presence sensor bracket 15. As shown in FIG. 7, card presence sensor 19 is a microswitch. Other non-limiting examples of card presence sensors include, but are not limited to, push-button switches, magnetic reed switches, acoustic sensors, optical sensors, magnetic hall-effect sensors, radio frequency identification sensors, or near field communication sensors. Card carrier holder 1, which may be a U-channel bracket, is further depicted in FIG. 7. FIG. 8 is a cutaway rear view of card module 150 also depicting card presence sensor 19 mounted on card presence sensor bracket 15 and card carrier holder 1. Card presence sensor 19 is configured to determine whether card 154 is within card carrier 5.

Figure 12:
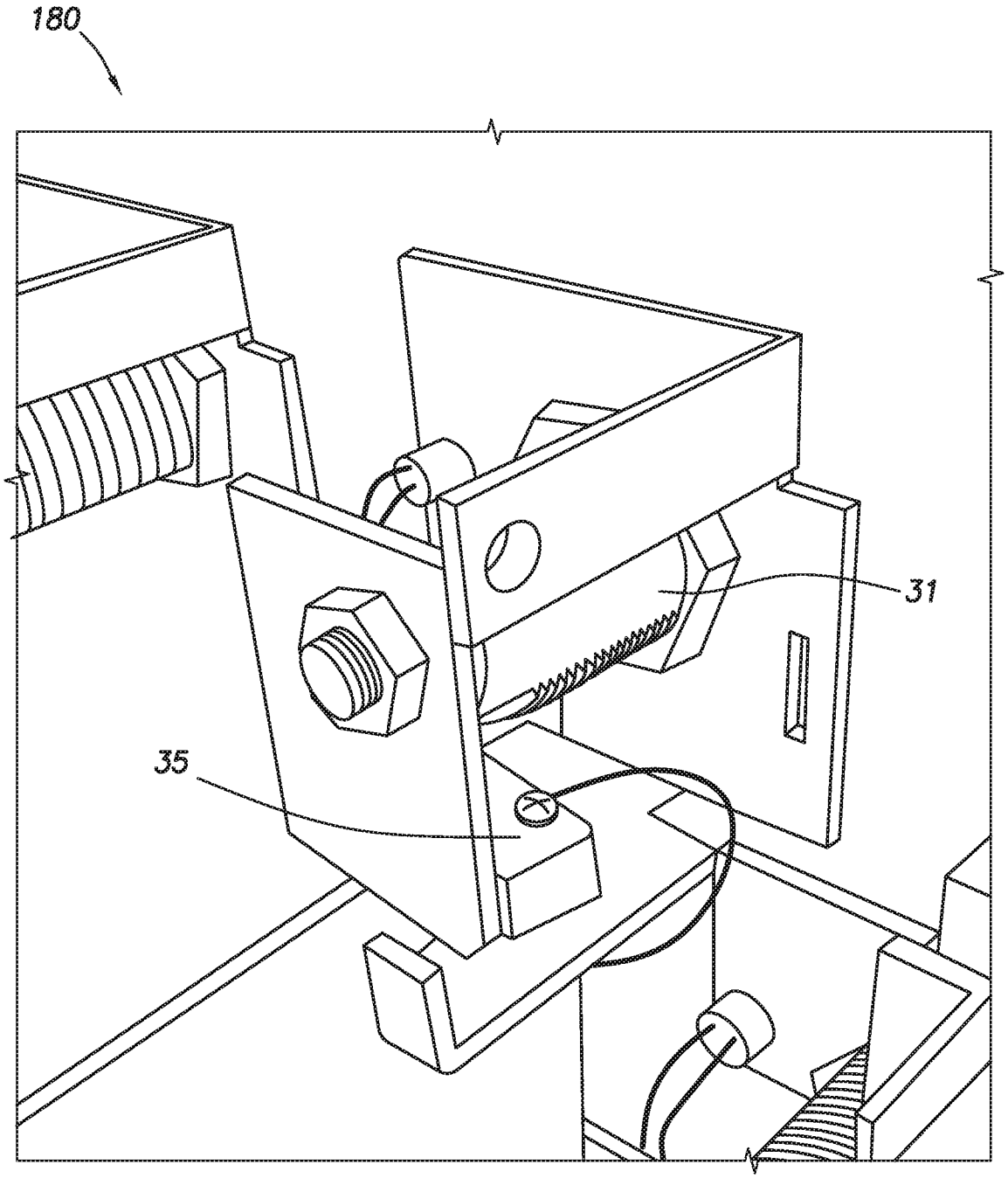
FIG. 12 is a rear view of a key module consistent with at least one embodiment of the present disclosure.
Figure 13:
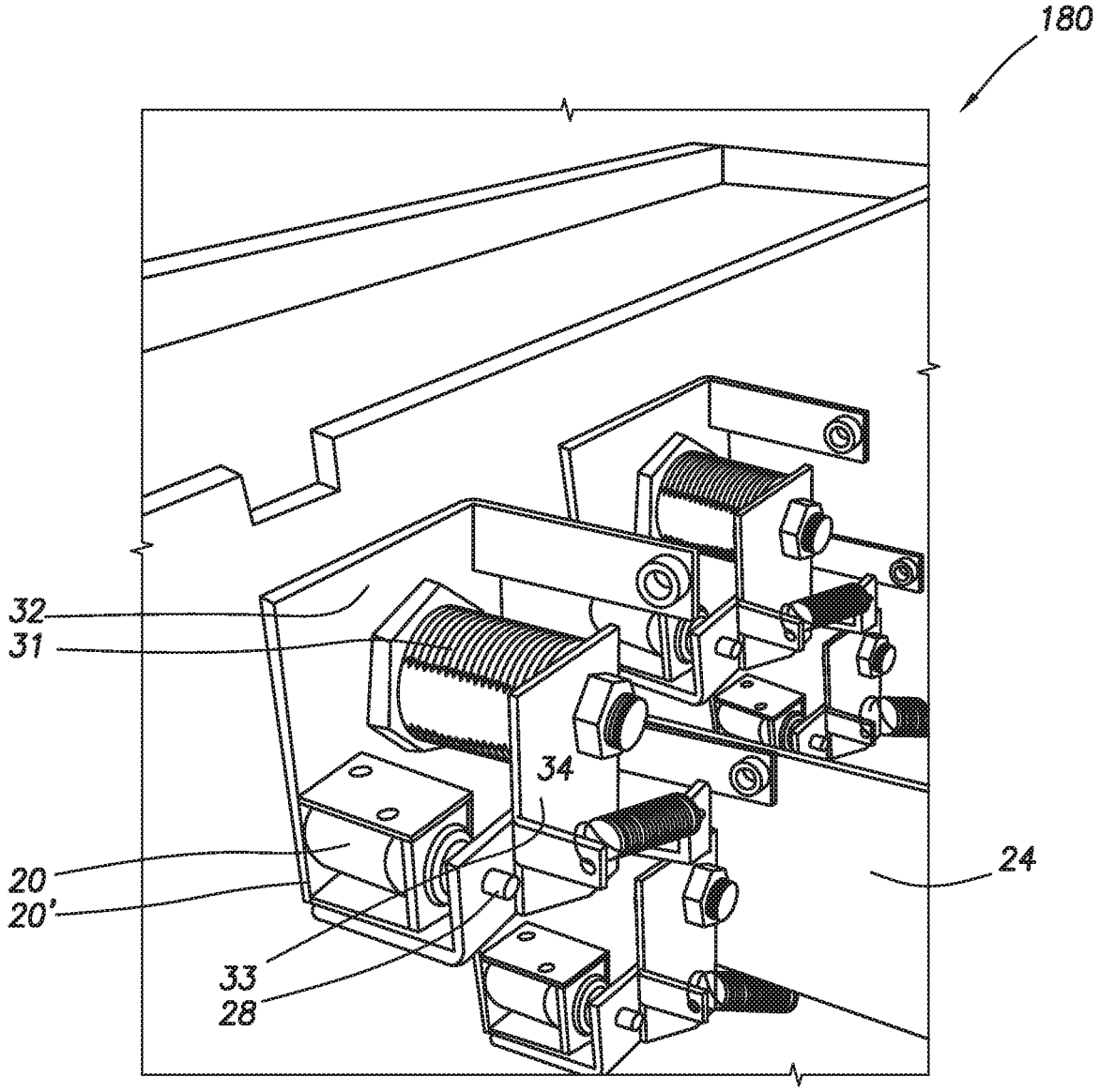
FIG. 13 is a rear view of a key module consistent with at least one embodiment of the present disclosure.

FIGS. 12 and 13 depict a rear view of key module 180. FIG. 13 depicts row board 24. Row board 24 is in data communication with locking solenoid 20. Locking solenoid 20 includes plunger 28. When locking solenoid 20 is energized, plunger 28 is pulled inwards towards locking solenoid body 20'. Key module 180 further includes lock housing 31. Lock housing 31 may be generally cylindrical and mechanically coupled to key bracket 32. Lock housing 31 may include within a lock cylinder, which is configured to receive key 184. The lock cylinder is mechanically coupled to rotating plate 33. Key module 180 further includes biasing spring 34, which is mechanically coupled to rotating plate 33. Key module 180 may also include key presence sensor 35. As shown in FIG. 11, key presence sensor 35 is a microswitch. Other non-limiting examples of card presence sensors include, but are not limited to, push-button switches, magnetic reed switches, acoustic sensors, optical sensors, magnetic hall-effect sensors, radio frequency identification sensors, or near field communication sensors.

During operation, key 184 may be received within the lock cylinder. When instructed by control board 25, row board 24 energizes locking solenoid 20, thereby pulling plunger 28 towards locking solenoid body 20'. Once plunger 28 is pulled towards locking solenoid body 20', rotating plate 33 is free to rotate, allowing a user to turn key 184 and remove key 184 from the lock cylinder. Pins within the lock cylinder may hold open the lock cylinder for later receipt of key 184. When key 184 is replaced into the lock cylinder, biasing spring 34 causes rotating plate 33 to rotate back to a closed position, whereby plunger 28 is pushed away from locking solenoid body 20', preventing rotating plate 33 from movement.

Figure 9:
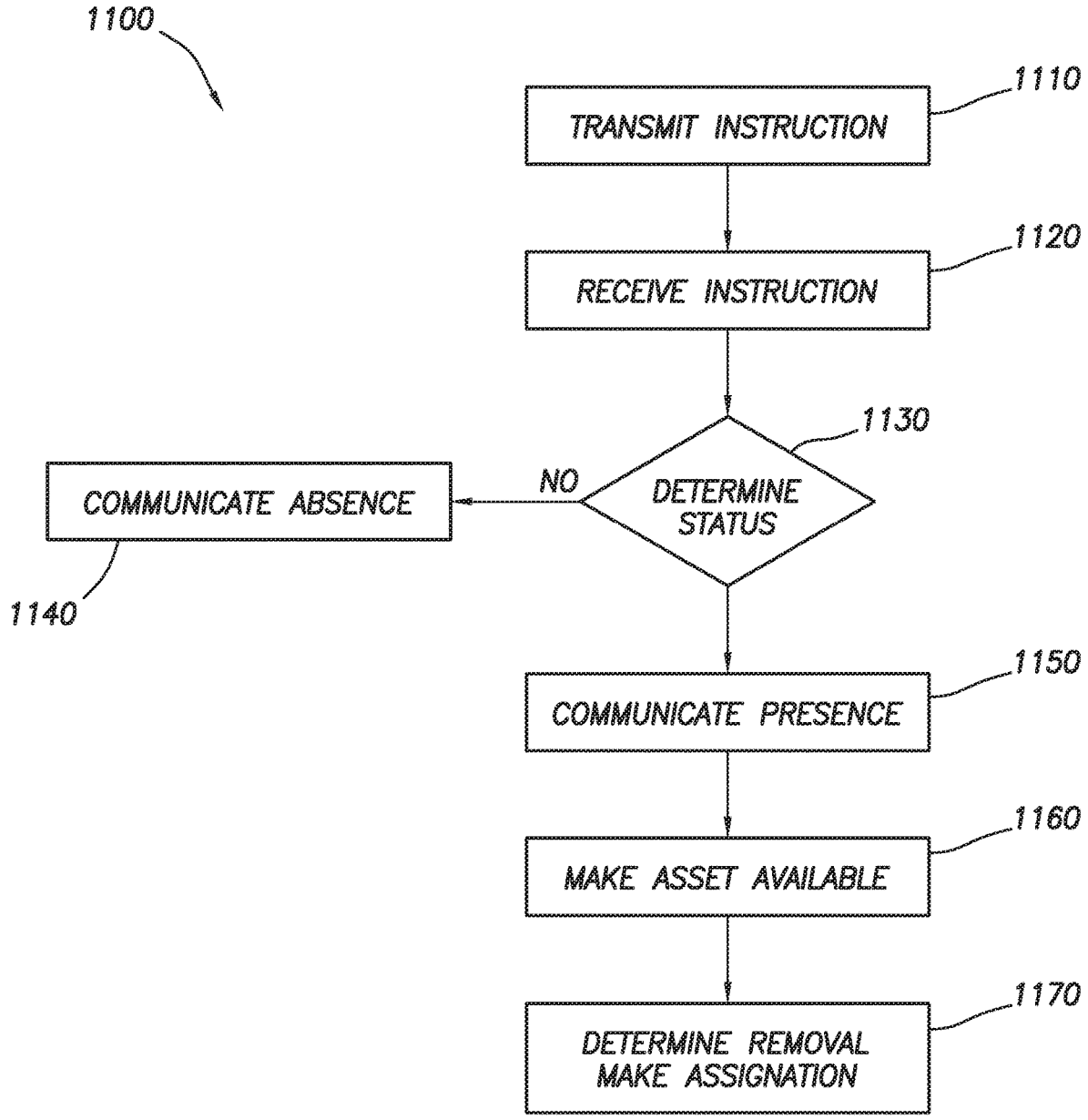
FIG. 9 is a block diagram of an asset unlocking method consistent with at least one embodiment of the present disclosure.

FIG. 9 depicts asset unlocking method 1100. Asset unlocking method 1100 includes transmit instruction 1110. In transmit instruction 1110, an instruction to allow access to an asset is transmitted to an asset containment module. For instance, as described hereinabove, computer command module 140" may transmit the instruction to allow access to an asset to key module 180, when the asset is a key, or to card module 150 when the asset is a card. Computer command module 140" may include one or more processors, non-transitory computer-readable media, input devices, and output devices. The non-transitory computer-readable media may have stored therein program instructions and databases for operation of modular asset storage system 10. Databases may include a list of users, access levels for each user, assets, and history of operation including which user removed or replaced which asset and when. Input devices may include a methods identifying the user and the asset to which the user desires access, including, but not limited to, a keyboard, keycard reader, retinal scanner, fingerprint scanner, wristband reader, or device having a software security token. In certain embodiments, transmit instruction 1110 may be made wirelessly; in other embodiments, transmit instruction 1110 may be made via wire, such as USB cable or RS-485 cable. In certain embodiments, the transmission made by computer command module 140" may include routing instructions that allow the transmission to reach the asset containment module containing the asset to be accessed.

Asset unlocking method 1100 further includes receive instruction 1120. In receive instruction 1120, the instruction to allow access is received. In certain embodiments, the instruction is received by control board 25. Control board 25 may include a processor, such as a microprocessor having non-transitory computer readable media for storage of information related to the identity and location of assets located in the asset containment module and storage of instructions for allowing access to assets located in the asset containment module.

In determine status 1130, control board 25 may determine if the asset to which access is to be allowed is present in the asset containment module in determine status 1130. Control board 25 may query row board 24, which based on readings from card presence sensor 19 or key presence sensor 35 whether the asset to which access is to be allowed is present in the asset containment module, such as, described above, in card carrier 5 or the key cylinder. If the asset is not present in the asset containment module, row board 24 transmits information regarding the absence of the asset to control board 25 as shown by communicate absence 1140 step.

If the asset is present in the asset containment module, control board 25 may communicate the presence of the asset in communicate presence 1150. In communicate presence 1150, control board 25 may energize, for instance, card slot indicator light 153, key slot indicator light 183, and door indicator light 185, or a combination thereof.

Following, before, or contemporaneously with communicate presence 1150, control board 25 may provide access to the asset (make asset available 1160). For instance, where door 6 is present, control board 25 may unlock door 6 through use of door solenoid 18 as described hereinabove. Control board 25 may further provide access to the asset by communicating to one of row boards 24 which locking solenoid 20 is to be de-energized or energized. The row board 24 may then de-energize or energize the locking solenoid 20 corresponding to the desired asset, allowing a carrier, such as card carrier 5, to be at least partially removed from the asset containment module or key 184 to be removed from the key cylinder. Once card carrier 5 is at least partially removed from the asset containment module, access to the asset may be obtained.

After the asset is removed from the carrier or the lock cylinder, a sensor, such as card presence sensor 19 or key presence sensor 35, may determine the absence of the asset and communicate the absence to control board 25, such as through row board 24. Control board 25 may communicate the absence of the asset to computer command module 140". Computer command module 140" may then assign the asset to the user. This process may occur in determine removal/make assignation 1170.

In certain embodiments, computer command module 140" may communicate an alert if assets other than those designated by computer command module 140" are designated. For instance, control board 25 determines from a signal sent from card presence sensor 19 or key presence sensor 35 that an asset other than that designated by computer command module 140" has been removed, a signal is sent from control board 25 to computer command module 140". Computer command module 140" may then communicate an alert, such as sounding an alarm, door indicator light 185 associated with the asset removed, email or text an alert to a user, or a combination thereof.

Figure 10:
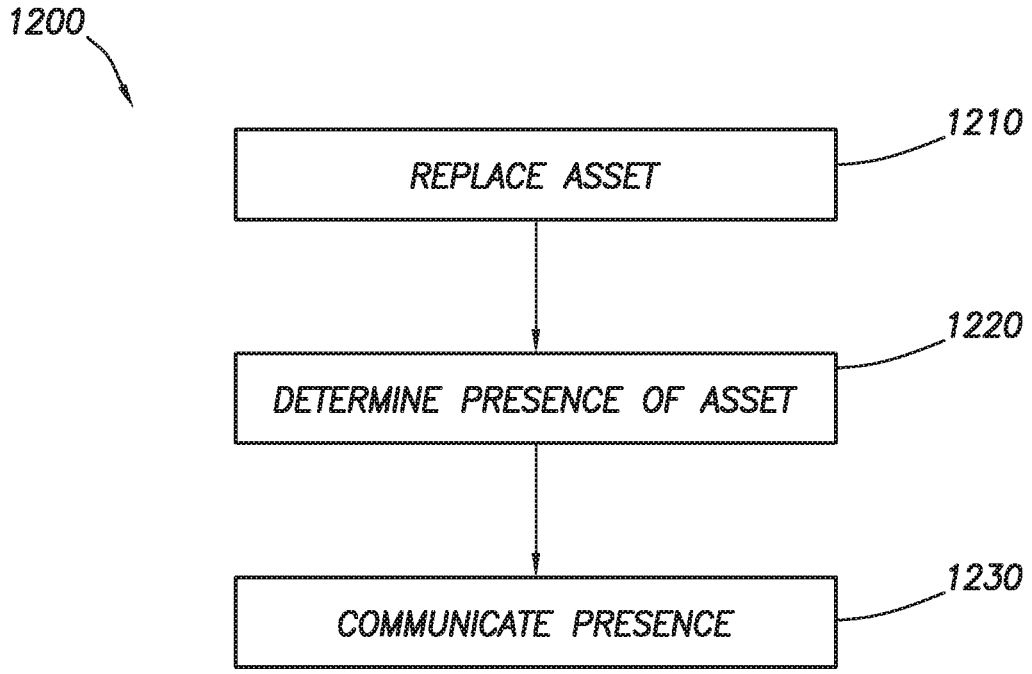
FIG. 10 is a block diagram of an asset replacement process consistent with at least one embodiment of the present disclosure.

FIG. 10 depicts asset replacement process 1200. In asset replacement process 1200, the asset is replaced in the asset containment module in replace asset step 1210. In certain embodiments, to allow access to the asset containment module, replace asset step 1210 may include input by the user into computer command module 140" to cause control board 25 to open door 6. In some embodiments, once computer command module 140" receives input from the user, computer command module may indicate which slot is assigned to the asset through use by energizing, for instance, card slot indicator light 153, key slot indicator light 183, and door indicator light 185, or a combination thereof.

Once the asset is replaced, a sensor, such as card presence sensor 19 or key presence sensor 35 may determine the presences of the asset and communicate with row board 24 (determine presence of asset 1220). Row board 24 may communicate the presence of the asset to control board 25, which may then transmit that information to computer command module 140" in communicate presence 1230.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An asset unlocking method, the asset unlocking method comprising:

a) providing a main panel and one or more asset containment modules, wherein the main panel includes a computer command module and wherein the asset containment modules are in data communication with the computer command module;

b) transmitting an instruction from the computer command module to the asset containment module to allow access to an asset;

c) receiving the instruction at the asset containment module;

d) determining whether the asset is present in the asset containment module;

e) if the asset is present, communicating the presence of the asset from the asset containment module to the computer command module; and f) providing access to the asset;

g) determining whether the asset has been removed from the asset containment module.

2. The method of claim 1, further including the steps of:

a1) before step b), identifying a user and an asset to which the user desires access; and g1) after step g), if an asset was removed, determining whether the asset that was removed is the same as the asset identified in step a1).

3. The method of claim 2, further including the step of providing an alert if the asset that was removed is not the same as the asset identified in step a1).

4. The method of claim 2, further including the step of:

g2) after step g), if an asset was removed, determining whether the user that removed the asset is the same as the user identified in step a1).

5. The method of claim 4, further including the step of providing an alert if the user that removed the asset is not the same as the user identified in step a1).

6. The method of claim 1, further including the steps of:

h) after step g), providing access to the asset containment module;

i) determining whether the asset has been replaced in the asset containment module; and j) transmitting the determination made in step i) to the computer command module.

7. The method of claim 6 wherein step h) includes providing input to the computer command module so as to cause the computer command module to provide access to the asset containment module, wherein the input includes an asset identification.

8. The method of claim 6 wherein at least one of the asset containment modules includes a face plate, the face plate having a plurality of slots, and wherein step h) includes the computer command module indicating a slot that is assigned to the asset.

9. The method of claim 8 wherein the asset containment module further includes at least one of a card slot indicator light, key slot indicator light, or door indicator light, wherein each indicator light is associated with a single slot, and wherein in step h) the computer command module indicates the slot by energizing at least one indicator light.

10. The method of claim 1 wherein each asset containment module is positioned within an expansion bay.

11. The method of claim 1 wherein the asset containment module includes a door positioned so as to restrict access to the slots.

12. The method of claim 1 wherein the asset containment modules include one or more locker box modules, card modules, key modules, or a combination thereof.

13. The method of claim 1 wherein the main panel includes a housing within which the computer command module and the one or more asset containment modules are contained.

14. The method of claim 1, further comprising one or more expansion panels, each expansion panel having one or more expansion bays.

15. The method of claim 14 wherein each of the one or more expansion panels is in data communication in a serial connection or parallel connection with the main panel.

16. The method of claim 14 comprising two or more main panels and one or more expansion panels, wherein the one or more expansion panels is in data communication in a network with the two or more main panels.

* * * * *